United States Patent [19]

Lautenschläger

[11] Patent Number: 4,919,548

[45] Date of Patent: Apr. 24, 1990

[54] DRAWER GUIDE

[75] Inventor: Horst Lautenschläger, Reinheim, Fed. Rep. of Germany

[73] Assignee: Karl Lautenschläger GmbH & Co. KG, Reinheim, Fed. Rep. of Germany

[21] Appl. No.: 274,057

[22] PCT Filed: Feb. 3, 1988

[86] PCT No.: PCT/EP88/00077

§ 371 Date: Sep. 23, 1988

§ 102(e) Date: Sep. 23, 1988

[87] PCT Pub. No.: WO88/05639

PCT Pub. Date: Aug. 11, 1988

[30] Foreign Application Priority Data

Feb. 3, 1987 [DE] Fed. Rep. of Germany ..... 3703051

[51] Int. Cl.[5] ..... A47B 88/14

[52] U.S. Cl. ..... 384/19; 312/348; 384/21

[58] Field of Search ..... 384/18, 19, 21, 22; 312/330 R, 341 R, 348

[56] References Cited

U.S. PATENT DOCUMENTS

| | | | |
|---|---|---|---|
| 3,773,395 | 11/1973 | Antonaccio | 384/18 |
| 4,119,377 | 10/1978 | Barber et al. | 384/22 X |
| 4,315,661 | 2/1982 | Kessler | 384/19 X |
| 4,447,095 | 5/1984 | Fielding | 384/19 |
| 4,601,522 | 7/1986 | Röck | 384/19 |

*Primary Examiner*—Thomas R. Hannon

[57] ABSTRACT

A drawer guide has a runner rail and a guide rail in the form of a channel, which can be displaced relative to one another by rolling on at least one wheel journaled at the drawer-front end of the guide rail and at least one wheel journaled on the rearward end of the runner rail, the wheels running each on a flange of their companion rail. The guide rail is of a channel-like configuration in which the flanges overreach the runner rail wheel and curl slightly around it. The free margin of the flange forming the track for the runner rail overreaches the guide rail wheel and curls slightly around it. As the fully extended position is approached, the width of the space between the web and at least one, preferably both, of the flanges of the guide rail narrows gradually over the length traveled by the runner rail wheel.

7 Claims, 1 Drawing Sheet

DRAWER GUIDE

BACKGROUND OF THE INVENTION

The invention relates to a drawer guide for drawers and other such extendable furniture parts, having a guide rail which can be fastened to the wall of the cabinet carcase and a runner rail which can be fastened to the extendable furniture part. The rails can be displaced lengthwise relative to one another on wheels mounted one on the front end of the one rail and one on the back end of the other rail and running each on the companion rail. The guide rail is in the form of a channel whose web is affixed to the cabinet wall and whose flanges project away from the web across the wheel of the runner rail and curl slightly around it, while the flange forming the track of the runner rail reaches across the wheel of the guide rail and curls slightly around it.

Drawer guides which are provided with one wheel at one end of the guide rail and another at the end of the runner rail and are therefore also referred to as "roller guides" when used in pairs on opposite sides of drawers, cutting boards, appliance holders and the like, are being used increasingly on account of their effortless action in comparison to friction guides. In the manufacture of furniture, inaccuracies constantly occur in the dimensions of the width of drawers and in the distance between the walls of the cabinet. These inaccuracies do not impair the operation of the drawers, because at least one of the pairs of guides permits the resultant lateral deviations of the wheels on their associated rail flanges, but lateral shifting of the drawer is at least possible when such lateral shifting is possible on both of the drawer guides. It can then happen that the vertical edges of the visible drawer fronts of a plurality of drawers arranged one over the other will no longer be exactly in line, which is unsightly. Also, the lateral guidance of the drawer is impaired, and this defect becomes greater as the drawer is drawn further out. A drawer pulled all the way out then has free transverse play on account of the shorter distance between the wheels of the guide rail and the wheels of the runner rail. To eliminate this transverse play, it is known to mount drawers with two different guides on the opposite sides of the drawers, while the flanges of the rails associated with the wheels are configured such that they also curl around the wheels, so that the lateral shifting of the rolls on the flanges is reduced. The inaccuracies of the width of the drawers and of the drawer opening then affect substantially the drawer guide on the opposite side, on which the flanges curled around the wheels are not used. The use of flanges curled around the wheels does not entirely eliminate the cross play because, in order to assure an easy and free running of the wheels the width of the flanges has to be slightly oversize and the flanges themselves are not bent sharply at right angles away from the webs of the guide rail and runner rail. Between the web of the one rail and the side of the wheel there is therefore an amount of space deliberately left for the heads of the screws with which the rail is fastened to the cabinet and, in many cases, to the side of the drawer. Moreover, this space is also necessary for the edge of the flange of the other rail which curls around the wheel of the first. In the fully open state, therefore, drawers mounted with such drawer guides are unstable, also on account of the above-mentioned short distance between wheels.

It is the object of the invention to create a drawer guide in which the cross play present in the fully extended state will be substantially reduced without impairing the easy running of the drawer guide.

SUMMARY OF THE INVENTION

Setting out from a drawer guide of the kind described above, this object is achieved in accordance with the invention by the fact that the free width measured between the web and the flange that curls around the runner rail wheel, on at least one, preferably both, of the flanges of the guide rail, gradually narrows over the length of the flange that is traveled by the runner rail wheel as the fully extended position of the drawer is approached. As a result the cross play is considerably reduced precisely in the critical, fully extended range of the drawer, because there is less side play of the wheels in the flange that curls around them. It is to be noted that the drawer guide configured in the manner of the invention is to be provided on only one side of a drawer or other extendable furniture part, while the second drawer guide is configured in the usual manner, i.e., without flanges that curl around the wheels.

In further development of the invention it is desirable to provide at least one low bead raised toward the wheel in the area of the web opposite the runner rail wheel in the fully extended position, i.e., one which will reach across the interstice normally existing between the runner rail wheel and the web surface of the guide rail, when the runner rail wheel is in the fully extended position.

In that case the configuration is preferably made such that two parallel beads embossed from the material of the web of the guide rail and offset in level from one another are provided, which just fill the gap between the web and the confronting side of the wheel in the fully extended position, i.e., which engage the side of the wheel facing the guide rail. These rib-like beads are best disposed at such a level that they will be opposite the flat side of the wheel at a distance above and below the central axis of the wheel. The area of engagement of the beads with the wheel is thus limited—like the margins of the flanges curled around the wheel on the opposite side—to the upper part and lower part of the wheel. Any projecting central hub portion or a journal projecting beyond the side of the wheel will then not interfere with the beads.

In addition to, or alternatively to, the above-described configurations of the drawer guide, it is recommendable gradually to decrease the width of the runner rail flange astride the top of the guide rail wheel in the end portion in which the guide rail wheel runs when the drawer guide is in the fully extended position. Thus the free play normally existing between the flange of the runner rail and the wheel in the fully extended position on the guide rail is reduced, which results in a corresponding reduction of the cross play of a fully extended drawer.

The effect being sought can also be further improved if the runner rail is provided in the area that is opposite the guide rail wheel in the fully extended state with a tab projecting from its bottom margin toward the confronting flat side of the guide rail wheel, which just covers the gap between the runner rail and the confronting flat side of the guide rail wheel.

The tab can be stamped out from the material of the runner rail itself and bent to the position in which it projects toward the guide rail wheel, or it is a separately made part which is fastened in the proper position on the runner rail, by spot welding, riveting or the like.

BRIEF DESCRIPTION OF THE DRAWING

The invention will be further explained below in the description of an embodiment, in conjunction with the drawing, wherein:

FIG. 1 is a cross section of a drawer guide designated as a whole by the number 10, it being assumed that the drawer guide 10 serves to guide one side 12 of a drawer on the associated wall 14 of a cabinet. On the opposite drawer side and the opposite cabinet wall, which are not shown, it is assumed that an additional, but conventional drawer guide of a mirror-image configuration, simpler than the one that is represented, is provided.

Figure 3:
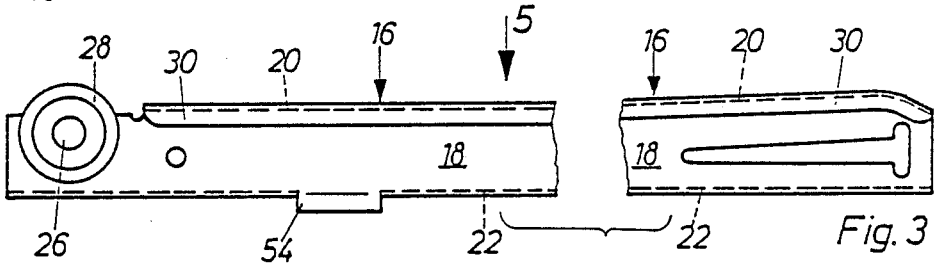
FIG. 3 is a view of the guide rail of the drawer guide, as seen in the direction of the arrow 3 in FIG. 1.

The drawer guide 10 has an elongated runner rail 16 which can be fastened to the drawer side 12 (see also FIGS. 3 and 5) and has two flanges 20 and 22 bent at approximately right angles in opposite directions from the vertical web 18. The runner fail 16 is fastened to the drawer side 12 such that the web 18 lies flat against the drawer side facing the supporting wall 14 and the bottom flange 22 lies flat against the bottom edge of the drawer side 12. The runner rail is fastened to the drawer side 12 with screws 24 driven through holes in the flange 22 into the bottom edge of the drawer side. At the back end of runner rail 16, i.e., the end within the cabinet, seen on the left in FIGS. 3 and 5, a wheel 28 journaled on a pin 26 riveted in the web 18 and projecting toward the cabinet wall, whose circumference projects slightly above the upper flange 20 of the runner rail 16 which is cut back in this end area. The edge of the flange 20 is furthermore bent downwardly along a narrow marginal strip 30. The bottom surface of the flange 20 between the web 18 and the downwardly bent marginal strip 30 thus forms the track for a second wheel to be described below.

The wheel 28 in turn rolls on tracks on the guide rail 32 (see also FIGS. 2 and 5), which is in the form of a channel with two flanges 36 and 38 bent approximately at right angles in the same direction from a web 34. The web 34 is screwed to the supporting wall 14 with the flanges 36 and 38 projecting toward the drawer side 12. The distance between the confronting inside surfaces of the flanges forming the tracks for the wheels 28 is only slightly greater than the diameter of the wheel 28. The wheel 28 therefore rolls on the inside surface of the top or bottom flange 36 or 38, respectively, depending on the position of the drawer, these flanges being again bent, one upward and the other downward along narrow strips 40 and 42, respectively, of their free margins. These narrow strips 40 and 42 therefore clutch the top and bottom of the wheel 28 of the runner rail. At the external or front end of the guide rail 32 the flanges 36 and 38 are cut back and the web 34 is enlarged to a flat plate 44 in which a journal pin 36 projecting toward the drawer side 12 is riveted, on which the above-mentioned second wheel 48 is journaled, on whose circumferential surface the track formed by the underside of the flange 20 of the runner rail 16 rides.

Figure 1:
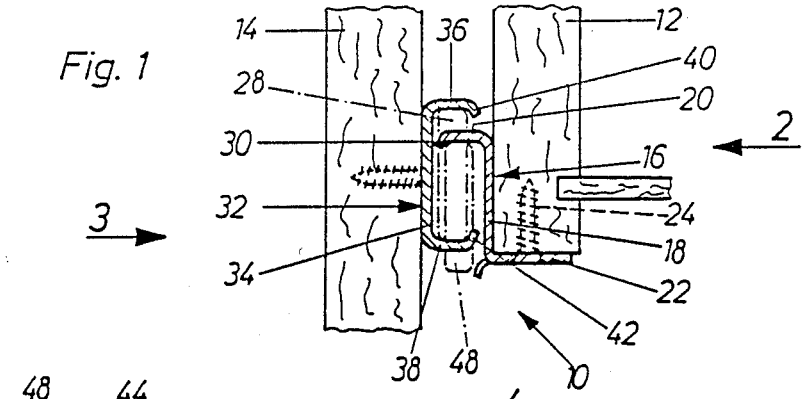
FIG. 1 is a cross section taken transversely of the direction of drawer movement through an embodiment of a drawer guide in accordance with the invention, in which the arrangement of the wheels with respect to the guide rail and runner rail is indicated in broken lines.
Figure 2:
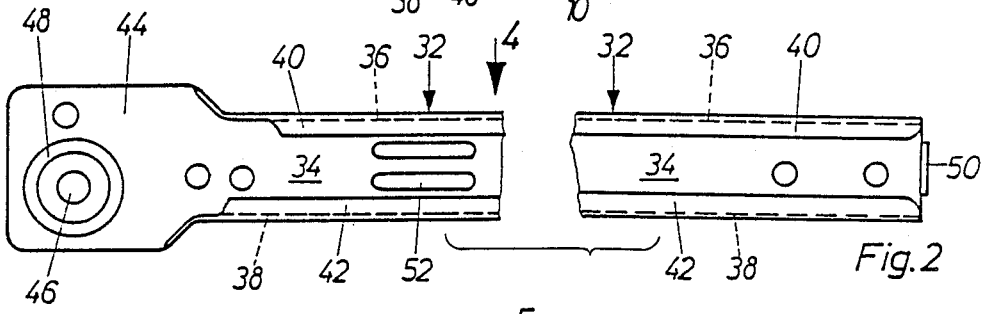
FIG. 2 is a view of the guide rail of the drawer guide, as seen in the direction of arrow 2 in FIG. 1.
Figure 5:
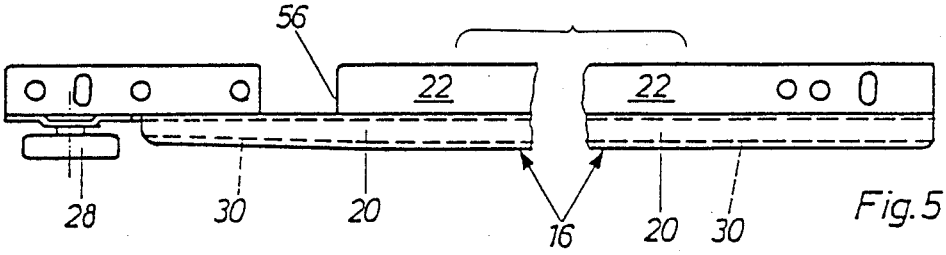
FIG. 5 is a view of the runner rail as seen in the direction of the arrow 3 in FIG. 3.

The end of the guide rail 32 that appears on the right in FIGS. 2 and 5 is closed to prevent the escape of the runner rail wheel 28 by a vertical tab 50 bent forward from the web 34 between the flanges 36 and 38.

In the assembled drawer guide, therefore, the wheel 28 rolls on the tracks formed on the guide rail 32 by the confronting inner surfaces of the flanges 36 and 38 and the wheel 48 on the track formed on runner rail 16 by the downwardly facing surface of the flange 20, while the narrow marginal strips 40 and 42 hold the wheel 28 at top and bottom and the marginal strip 30 holds the wheel 48 at the top, so that the assembled guide rail and runners have only a certain, relatively slight play at right angles to the drawer movement, but are not separable from one another in this transverse direction.

Figure 4:
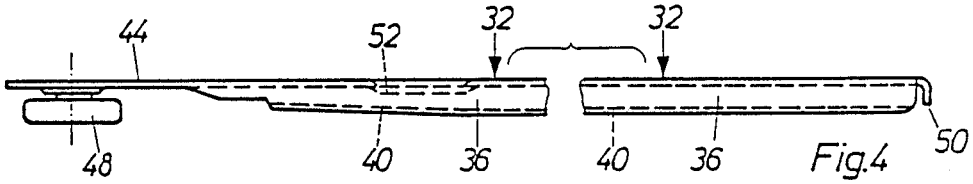
FIG. 4 is a view of the guide rail as seen in the direction of the arrow 4 in FIG. 2.

To reduce the play prevailing between the runner rail and guide rail transversely of the direction of drawer movement when the drawer is in the fully extended position, a number of measures are taken which are described below. Thus, in the manner that can be seen in the plan view in FIG. 4, as the fully extended position of the drawer is approached, the free space between the marginal strips 40 and 42 of the flanges 36 and 28 and the web 34 of the guide rail 32 diminishes in the end area on the left in FIGS. 2 and 4, in comparison with the normal free width provided over the rest of the length of the guide rail.

This effect is enhanced by two parallel beads 52 situated at different levels in the area of the fully-extended end position of the runner rail wheel 28, which are embossed from the web 34 of the guide rail 32 to such an extent that they come into contact with the confronting flat side of the wheel 28.

On the runner rail 16 other steps are taken to reduce the cross play in the fully extended position. Like the reduction described above of the width of the flanges 36 and 28 of the guide rail 32, the width of the flange 20, or its clearance between the web 18 and the margin 30 in the end area over which the guide rail wheel 48 runs as the fully extended end position is approached, gradually diminishes; this can be seen in FIG. 5 on the flange 20 which becomes narrower toward the left end.

Furthermore, the runner rail 16 is provided in the area opposite the guide rail wheel 48 in the fully extended position with a tab 54 which reaches across the interstice between the web 18 and the confronting flat side of the guide rail wheel 48 and comes in contact with the wheel 48 in its lower circumferential area. In the illustrated case the tab 54 is stamped from the material of the runner rail itself and bent to the position in which it projects toward the guide rail wheel. The material of the tab 54 originates from the area of the cut-out 56 in the lower flange 22 of the runner rail 16, as seen in FIG. 5. Alternatively the tab can, of course, consist of a separately made metal plate piece spot-welded to the flange 22.

I claim:

1. A drawer guide for drawers and other such extendable furniture parts, having a guide rail adapted to be fastened to a wall of a cabinet carcase, and a runner rail adapted to be fastened to an extendable furniture part, said rails being displaceable lengthwise relative to one another on two wheels, one of said wheels being mounted on a front end of the guide rail and running on the runner rails, the other wheel being mounted on a back end of the runner rail and running on the guide rail, the guide rail being in the form of a channel with a web affixed to a cabinet wall and having two flanges projecting away from the web beyond the wheel of the runner rail and curling slightly around the safe to form two edges, while a flange forming a track of the runner rail overreaches and slightly curls around the top of the wheel of the guide rail, the free width measure between the web and the edges curling around the runner rail wheel of at least one of the flanges the guide rail, gradually diminishing outwardly from the carcase interior toward the fully extended position of the drawer guide in an area thereof traveled by the runner rail wheel as the same approaches the fully extended position.

2. A drawer guide according to claim 1, comprising at least one bead at the web opposite the runner rail wheel in the fully extended position.

3. A drawer guide according to claim 2, comprising two beads in the form of low rib-like projections parallel to one another at different levels, embossed from the material of the web, said beads reaching across the interstices between the web and a confronting flat side of the runner rail wheel in the fully extended position.

4. A drawer guide according to claim 3, wherein the rib-like projections are disposed at such a level that they are opposite the flat side of the wheel at a distance above and below the axis of rotation of he runner rail wheel.

5. A drawer guide according to claim 1, wherein the free width of the flange of the runner rail curling around the top of the guide rail wheel diminishes in an end area traveled by the guide rail as the fully extended position is approached.

6. A drawer guide according to claim 1, wherein the runner rail is provided, in an area opposite the guide rail wheel in the fully extended position, with tab projecting from a bottom margin toward a confronting flat side of the guide rail wheel, said tab reaching across the internal existing between the runner rail and the confronting flat side of the guide rail wheel.

7. A drawer guide according to claim 6, wherein the tab is stamped out from the material of the runner rail itself and bent to the position projecting toward the guild rail wheel.

* * * * *